US005255673A

United States Patent [19]

Cardwell et al.

[11] Patent Number: 5,255,673

[45] Date of Patent: Oct. 26, 1993

[54] PRESSURE VESSELS

[75] Inventors: John F. Cardwell, Nuneaton; Simon C. Martin, Coventry; James H. C. Rowan, Worcester; Riyadh N. A. Alaka, Guildford; John S. Selby, London, all of United Kingdom

[73] Assignee: Courtaulds Plc & SOS Limited, London, England

[21] Appl. No.: 730,826

[22] PCT Filed: Jan. 26, 1990

[86] PCT No.: PCT/GB90/00107

§ 371 Date: Jul. 26, 1991

§ 102(e) Date: Jul. 26, 1991

[87] PCT Pub. No.: WO90/08692

PCT Pub. Date: Aug. 9, 1990

[30] Foreign Application Priority Data

Jan. 27, 1989 [GB] United Kingdom ..... 8901840

[51] Int. Cl.[5] ..... A62B 31/00

[52] U.S. Cl. ..... 128/202.12; 600/21; 128/205.26; 405/185

[58] Field of Search ..... 128/30, 202.12, 204.18, 128/205.26; 600/21; 138/153, 172, DIG. 2; 405/185, 186, 187, 188, 192, 193

[56] References Cited

U.S. PATENT DOCUMENTS

| | | | |
|---|---|---|---|
| 2,366,067 | 12/1944 | Smith | 285/71 |
| 2,401,230 | 5/1946 | Colley | 128/205.26 X |
| 2,448,546 | 9/1948 | Plemel et al. | 128/205.26 X |
| 3,316,828 | 5/1967 | Boehmer | 128/205.26 X |
| 3,447,572 | 6/1969 | Vanderbilt et al. | 138/153 X |
| 3,483,896 | 12/1969 | Grosh | 138/153 X |
| 3,602,221 | 8/1971 | Bleicken | 128/125.26 |
| 3,729,002 | 4/1973 | Miller | 128/125.26 |
| 3,768,467 | 10/1973 | Jennings | 128/205.26 |
| 4,057,610 | 11/1977 | Goettler et al. | 138/172 X |
| 4,205,034 | 5/1980 | Newberry | 138/DIG. 8 X |
| 4,633,912 | 1/1987 | Pilkington et al. | 138/153 X |

FOREIGN PATENT DOCUMENTS

| | | | |
|---|---|---|---|
| 0168941 | 1/1986 | European Pat. Off. . | |
| 0191700 | 8/1986 | European Pat. Off. . | |
| 532195 | 8/1931 | Fed. Rep. of Germany | 128/205.26 |
| 699062 | 11/1940 | Fed. Rep. of Germany | 128/205.26 |
| 3004156 | 8/1981 | Fed. Rep. of Germany | 128/202.12 |
| 840076 | 4/1939 | France | 128/205.26 |
| 1460707 | 12/1966 | France . | |
| 2089040 | 12/1971 | France . | |
| 0929103 | 5/1982 | U.S.S.R. | 128/205.26 |
| 7228 | 12/1915 | United Kingdom . | |
| 457231 | 11/1936 | United Kingdom | 128/205.26 |
| 546199 | 7/1942 | United Kingdom . | |
| 739575 | 11/1955 | United Kingdom . | |
| 2164984 | 4/1986 | United Kingdom . | |

*Primary Examiner*—V. Millin
*Assistant Examiner*—Sebastiano Passaniti
*Attorney, Agent, or Firm*—Davis Hoxie Faithfull & Hapgood

[57] ABSTRACT

An inflatable pressure vessel (1), which may be a decompression chamber for treating divers, has a flexible elongate casing (2) made of a silicone elastomer material reinforced with windings of reinforcing filaments and one or more removable end members (7,8) to provide access. An end member may be a rigid plate which seals against a frame (3,4) defining the entrance under internal vessel pressure. A transparent plastic plate gives illumination and allows inspection of a diver under treatment in a decompression chamber. Two pressure vessels (31,32) may be connected by a linking element (24) comprising a male part (25) which seals within a female part (33,34) under internal pressure and which has inter-engaging projections (29,35) and depressions (30,36) to prevent the parts from sliding apart axially under that pressure.

8 Claims, 3 Drawing Sheets

PRESSURE VESSELS

BACKGROUND OF THE INVENTION

This invention relates to pressure vessels, and particularly to decompression chambers used to protect divers suffering from decompression syndrome (bends). Fixed metal decompression chambers are usually located at permanent sites in hospitals and medical centres. However, since delay in treatment can worsen the condition and lead in some cases to death, portable decompression chambers have been developed.

In order to reduce the weight of portable chambers still further and make them stowable for ease of carrying in helicopters and small boats, collapsible chambers have been developed in which the chamber is a flexible bag which becomes inflated by the chamber pressure. One such chamber, also known as a hyperbaric chamber, is described in GB-A-2,164,984.

The present invention is concerned with the construction of a pressure vessel of the type having a flexible wall and also discloses a linking element for connecting two pressure vessels so that, for example, a diver temporarily under treatment in a portable decompression chamber can be transferred to a fixed decompression chamber without possible fatal loss of pressure.

SUMMARY OF THE INVENTION

According to this invention, an inflatable pressure vessel comprises an elongate casing having end members for closing the casing to form a vessel of which at least one of the end members is removable to provide access to the interior of the vessel, the casing comprising a flexible tubular wall of a silicone elastomer material incorporating windings of reinforcing filaments or yarns.

The inflatable pressure vessel may be a decompression chamber having a casing of a size when inflated to accommodate a recumbent person.

The tubular casing is preferably cylindrical or frustoconical and is preferably of circular cross-section. The removable end member (or members) may be a rigid plate of a shape and size corresponding to the cross-section of the inflated casing and sealingly locatable from within the casing against an internal frame secured to the wall of the casing and defining the open end of the casing which the end member is to close. Thus, internal vessel pressure forces the rigid end plate against an inwardly-facing surface of the frame to seal the vessel.

With a casing of circular cross-section, the rigid end plate may be a disc which seats against the inside surface of a ring which is fixed to the wall of the casing around the open end or is moulded integrally with the wall. If the compression vessel has the tubular female part of a linking element formed as an extension of the wall of the casing, then the frame or ring against which the rigid end plate or disc is to seat may be located co-axially adjacent to that female part of the linking element between the linking element and the main body of the casing. Insertion of a rigid end member through the open end of the casing into its interior is facilitated if the female part of the linking element has a degree of flexibility.

The services for the pressure vessel such as pressurising gas feeds may be provided through one or more ports in the at least one end member or both end members.

The at least one end member or both end members may be a rigid plate or disc as mentioned and this is preferably of a domed shape to increase its strength against internal pressure in the vessel. For a decompression chamber where lightness of weight is important, a plastics material may be used for the end members and this is preferably transparent to allow illumination of the chamber and inspection of a person contained therein. A transparent acrylic plastics material is suitable in this regard.

The material used for the construction of the casing of the inflatable pressure vessel is important. Silicone elastomer materials provide the required combination of lightness in weight, flexibility and toughness in use as well as being essentially non-toxic to humans and having low flammability characteristics. All of these properties are important in relation to portable decompression chambers in particular.

In addition, silicone elastomer materials have good processing properties in the filament winding process used to make the casing of the pressure vessel. Suitable materials can be obtained as two-component liquid resin systems which on mixing the two components yields a material having appropriate viscosity and pot life for a filament winding process and having a suitable curing cycle.

Examples of suitable silicone elastomer materials are those produced by the General Electric Corporation under their codes SLE 5300, RTV 615 and RTV 630 and by Dow Corning Limited under their trade name Sylgard 182. For example, SLE 5300 has a viscosity on mixing of the two components of 16,000 centipoises, a pot life at a temperature of 25° C. of 48 hours and a cure cycle of 15 minutes at a temperature of 120° C. The cured elastomer has a Shore A Durometer hardness of 33. The equivalent figures for RTV 630 are viscosity-150,000 centipoises; pot life (25° C.)-4 hours, cure cycle-1 hour at 100° C.; and a Shore Durometer hardness of 65.

The casing of the pressure vessel may be formed by winding reinforcing filaments or yarns circumferentially onto a mandrel of the appropriate size. The reinforcing filaments may be in the form of a tow or band or yarn of filaments and may be of any suitable material such as glass or high strength polymers. Polyaramid filaments or yarns such as "Kevlar" (Registered Trade Mark) are preferred. The filaments or yarns may be pre-impregnated with the silicone elastomer precursor, additional quantities of which may be applied directly onto the mandrel if necessary. Gel coats may be applied pre- and/or post-winding to give a smooth surface to the casing or to apply, for example, a more abrasion-resistant inner and/or outer coating.

The winding process for the reinforcing filaments or yarns may employ suitable lay up patterns according to design requirements including hoop windings, angled windings and cross-windings. Local reinforcement using woven fabrics or tapes may be introduced during winding according to design requirements and a frame or ring for eventual location of the at least one end member may be incorporated during or after winding.

The loading of filaments or yarns in the flexible tubular wall of the casing may be varied to suit performance requirements. A loading of 50 to 60 percent by volume, preferably about 55 percent by volume, of filaments or yarns is a suitable loading for many applications.

After winding, the silicone elastomer material may be cured by heating it on the mandrel using, for example, an oven or radiant heat and then the resulting casing may be removed from the mandrel.

The winding-reinforced silicone elastomer casing has high tensile strength and good tear strength combined with the other properties outlined above. In addition, silicone elastomer materials can be pigmented without any great loss of strength or flexibility which allows suitable colouration of the pressure vessel, for example in Naval Service colours.

A linking element for connecting the respective interiors of two pressure vessels in fluid-tight relation comprises a tubular female part sealingly connected to an entry port of a first pressure vessel according to the invention and a tubular male part sealingly connected or connectable to an entry port of the second pressure vessel, the tubular male part having at least part of its external surface shaped to correspond with at least part of the internal surface of the female part and to seal against that surface when the vessels are internally pressurised, said respective surfaces each having projections and depressions which engage and hold the surfaces against their sliding axially apart under internal vessel pressure. Preferably, the male and female parts are cylindrical in shape.

The wall defining the external surface of the male part is preferably flexible to facilitate sealing of the corresponding surfaces against each other under internal vessel pressure. Flexibility also facilitates insertion of the male part into the position of engagement within the female part.

The projections and depressions are preferably a succession of circumferential beads and grooves of which the beads of one part engage in the grooves of the other. With this arrangement, the wall of the male part needs to be sufficiently flexible to allow the beads on the male part to pass within the beads on the female part during insertion of the male part into the female part.

Preferably each bead on the internal surface of the female part of the linking element has sides with different angles of slope similar to saw teeth. In axial cross-section, the beads of the female part can have sides with different angles of slope in relation to the longitudinal axis of the female part, with those sides of the beads which are to face towards the entrance to the female part being steeper in slope than the opposite sides of the beads. The beads on the male part can also have sides with different angles of slope, in cross-section, in relation to the longitudinal axis of the male part so that when the parts are linked, the respective sides of the beads of the male and female parts which engage have corresponding angles of slope. Thus the beads on the male part can have sides with angles of slope which make then generally parallel to the respective sides of the beads on the female part which they engage when the parts are linked.

Contrary to initial expectation, this design of bead gives better resistance against axial separation of the male and female parts of the linking element under the influence of internal vessel pressure than the reverse relationship of bead side slope.

The male part of the linking element may be sealingly connected or connectable to the second pressure vessel in the same way in which it is connected or connectable to the first pressure vessel. Thus, the second pressure vessel may also have a tubular female part sealingly connected to an entry port and the tubular male part may be a double ended component which engages the respective female parts of the two pressure vessels at opposite ends.

The linking element is particularly useful for connecting two decompression chambers so that access to one chamber from the other may be achieved without loss of pressure. To allow passage of a person from one chamber to the other, the tubular parts of the linking element need to be of a suitable size. It is convenient to have the linking element of the same cross-sectional size and shape as at least one of the pressure vessels. In that case, the tubular female part of the linking element may be an integral part of the pressure vessel, being incorporated in, or formed as an extension of the wall of the pressure vessel, preferably at the end of the vessel which is intended to accommodate the head end of a person contained therein.

The tubular parts of the linking element are preferably of circular cross-section. Each may be formed from a fibre-reinforced plastics material for strength combined with lightness of weight and a preferred technique is to form them by filament winding using resin-impregnated high strength filaments or yarns such as the polyaramid filaments "Kevlar". As mentioned, the tubular female part of the linking element is formed as an integral part of a pressure vessel according to this invention and thus is formed from windings of reinforced filaments or yarns incorporated in a silicone elastomer material.

The linking element described herein may be used to connect a portable decompression chamber according to this invention to another decompression chamber which may be a fixed unit or another portable chamber.

BRIEF DESCRIPTION OF THE DRAWINGS

The invention will now be further described, by way of example, with reference to the accompanying drawings in which.

DESCRIPTION OF PREFERRED EMBODIMENTS

Figure 1:
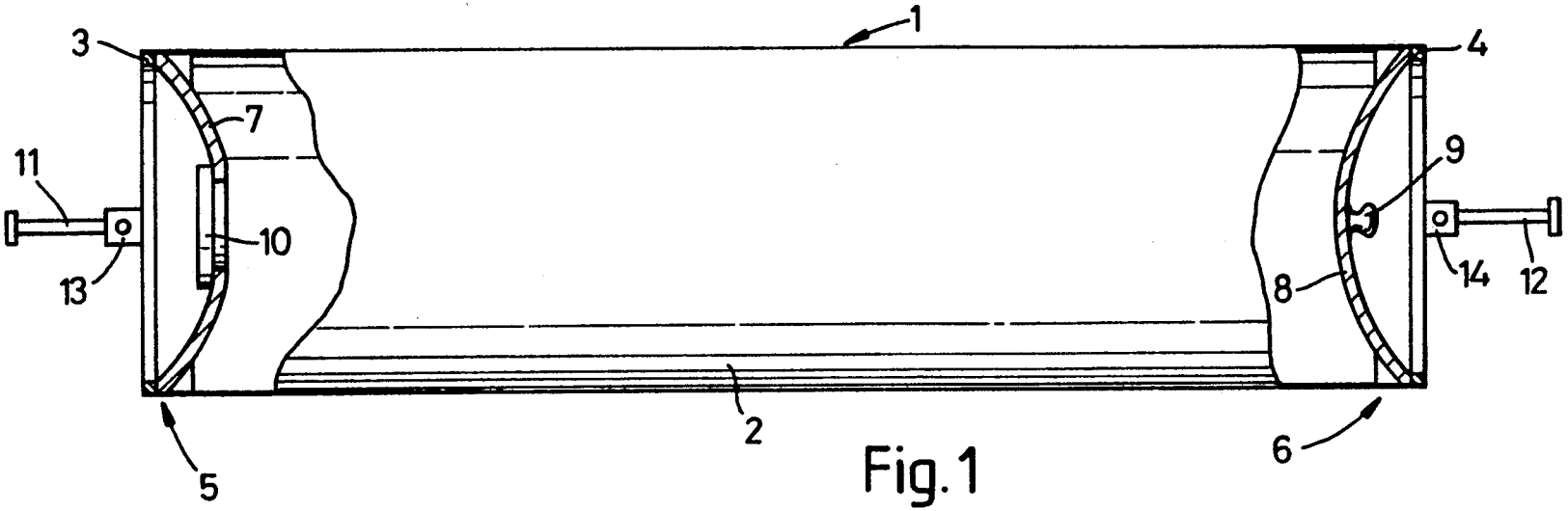
FIG. 1 is a partially sectioned side view of a portable decompression chamber according to the invention, (without any provision of a linking element), FIGS. 2(*a*), 2(*b*), 2(*c*) and 2(*d*) are schematic diagrams showing how a patient is placed inside a portable decompression chamber as shown in FIG. 1 with the chamber in the non-pressurised and pressurised conditions, FIGS. 3(*a*) and 3(*b*) are schematic diagrams showing how the flexible casing of a portable decompression chamber folds down for storage and transportation, FIGS. 4(*a*) and 4(*b*) show a link element for connecting two decompression chambers according to the invention.

Referring to FIG. 1 a decompression chamber 1 comprises a flexible cylindrical casing 2 of circular cross-section having two end rings 3 and 4 moulded into the casing wall. These rings 3 and 4 frame the ends of the cylindrical casing 2, that is the foot end 5 and the head end 6 respectively, and provide abutments against which rigid end domes 7 and 8 may seat to give a fluid-tight seal when the chamber is internally pressurised. The casing is of a silicone elastomer material incorporating windings of reinforcing filaments according to the invention. The end domes 7 and 8 may be of a transparent plastics material. The end dome 8 which is located at the head end 6 of the casing 2 has a dome handle 9. The end dome 7 which is located at the foot end 5 of the casing 2 has a central plate 10 which incorporates a dome handle (not shown) and also fittings (not shown) for attaching gas hoses for pressurising the chamber 1. Removable chamber handles 11 and 12 are attachable to lugs 13 and 14 moulded into the foot and head ends 5 and 6 respectively of the casing 2.

Referring to FIGS. 2(*a*) and 2(*b*), a patient 15 suffering from decompression syndrome is placed on a stretcher 16 which is slid into the laid out casing 2 of the decompression chamber 1 (FIG. 2(*a*)). The end dome 7 is fitted to the foot end 5 of the casing 2 and hoses 17 and 18 leading from gas bottles 19 and 20 by way of control box 21 are attached to the hose fittings located in the central plate 10 of the end dome 7. The end dome 8 is then fitted into the head end 6 of the casing 2 (FIG. 2(*b*)).

The chamber 1 is then pressurised by feeding gas into it from the gas bottles 19 and 20 and becomes rigid (FIG. 2(*c*)). The chamber handles 11 and 12 are then fitted, the control box 21 is strapped onto the casing 2 and the gas bottles 19 and 20 are carried on the back of one of the bearers 22 and 23 carrying the chamber by the handles 11 and 12 with the patient 15 inside (FIG. 2(*d*)).

Figure 3B:
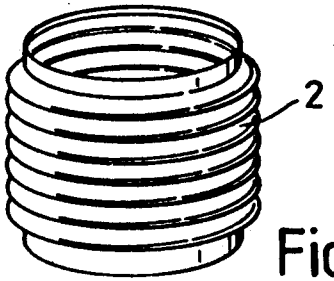
Figure 3A:
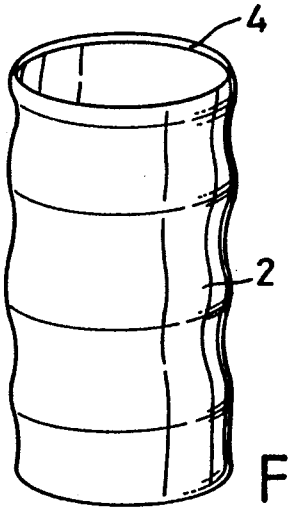
Figure 2A:
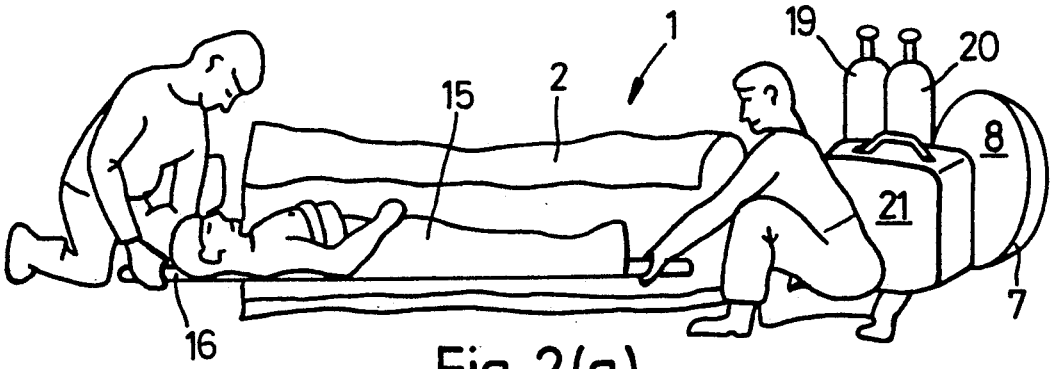
Figure 2B:
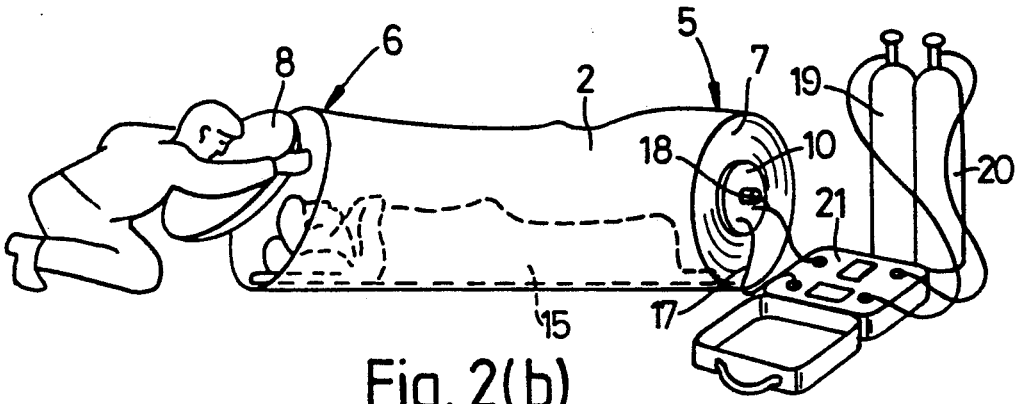
Figure 2C:
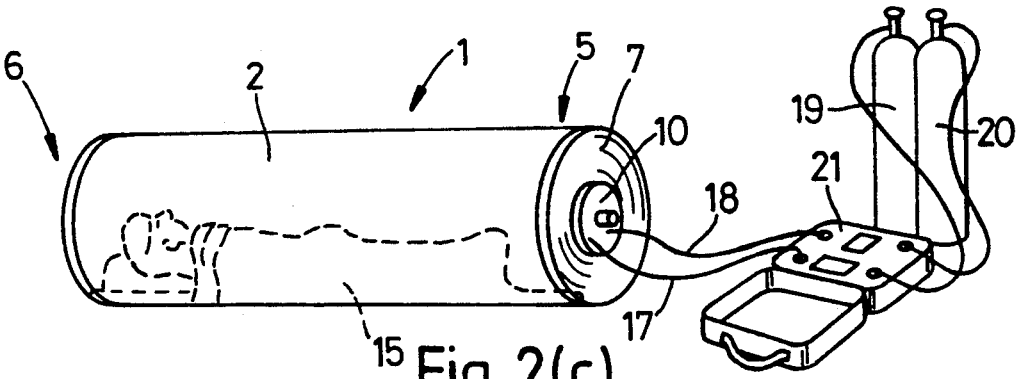
Figure 2D:
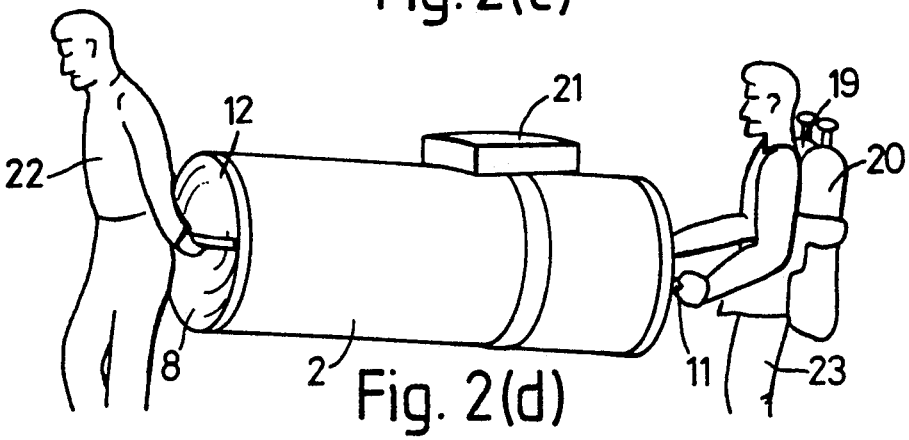

FIGS. 3(*a*) and 3(*b*) show how the flexible casing 2 of the decompression chamber 1 can be folded down in a concertina-like action from the position shown in FIG. 3(*a*) to that shown in FIG. 3(*b*) for ease of storage and transportation.

Figure 4A:
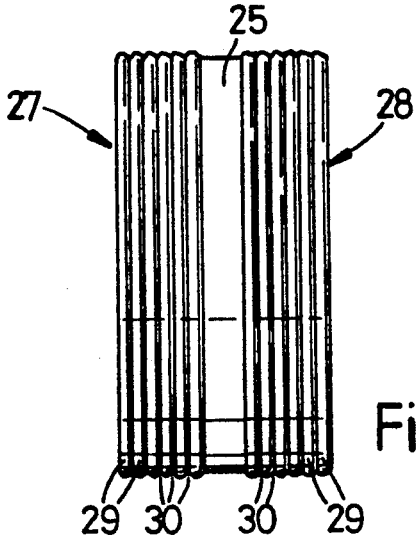
Figure 4B:
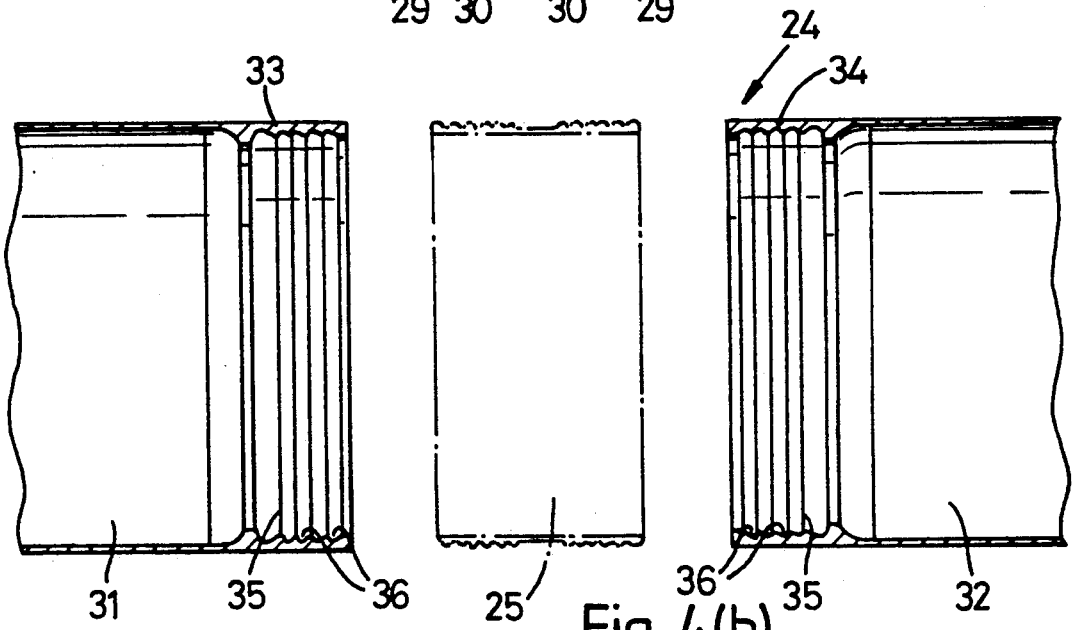

FIGS. 4(*a*) and 4(*b*) show a linking element 24. A cylindrical tubular male part 25 shown in full line in FIG. 4(*a*) and outline in FIG. 4(*b*) has a flexible wall with two series 27 and 28 of alternating beads 29 and grooves 30 moulded into its outer surface at both ends.

Each of the two decompression chambers 31 and 32 partly-shown in FIG. 4(*b*) has a tubular cylindrical female part (33 and 34 respectively) of the linking element 24 as an extension of the chamber wall. The female parts 33 and 34 each have alternating circumferential beads 35 and grooves 36 on their internal surfaces and these are complementary in size and shape to the beads 29 and grooves 30 moulded externally on the male part 25.

Figure 5:
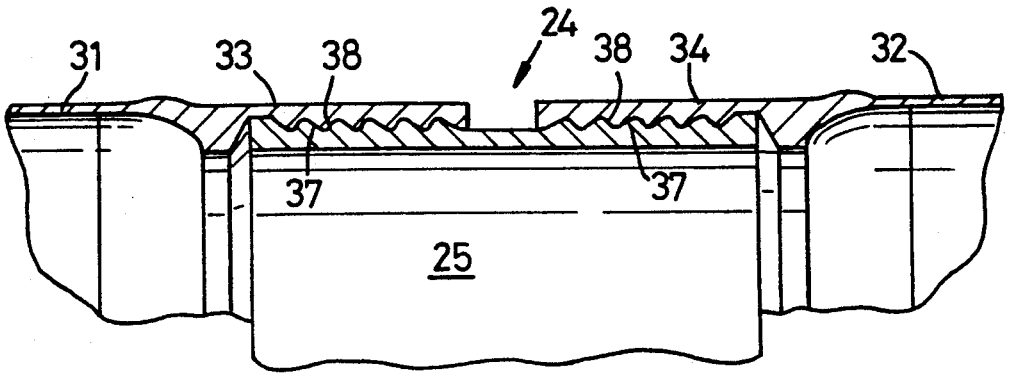
FIG. 5 shows a part view of the link element of FIGS. 4(*a*), 4(*b*) on an enlarged scale and in connecting engagement with two decompression chambers.

FIG. 5 shows the male and female parts (25, 33 and 34) of the linking element 24 in sealing engagement to provide a fluid-tight link between the two decompression chambers 31 and 32. As mentioned earlier, the slope of each side 38 of the circumferential beads 35 on the female parts 33 and 34 (as seen in axial cross-section) which face towards the respective entrances of the female parts 33 and 34 in relation to their common longitudinal axis is steeper than the opposite sides 37 of the beads 35. The reverse is of course true for the beads 37 of the beads 35. The reverse is are complementary to the intervening grooves 36 on the female parts 33 and 34.

This shaping of beads nad grooves is the opposite of what one might expect to be optimum in preventing relative axial movement apart of the male and female parts of the linking element 24, but in fact is the stronger arrangement.

We claim:

1. An inflatable decompression chamber of a size when inflated to accommodate a recumbent person comprising an elongate tubular casing having end members for closing the casing to form the chamber, at least one of the end members being removable to provide access to the interior of the chamber, the casing comprising a flexible tubular wall of a silicone elastomer material incorporating continuous circumferential windings of filaments or yarns within the wall.

2. An inflatable decompression chamber as claimed in claim 1 wherein the tubular casing when not inflated is capable of being folded down for purposes of storage and transportation.

3. An inflatable decompression chamber as claimed in claim 1 wherein the tubular casing has an open end closable by the removable end member; said open end being defined by an internal frame which is integral with the wall of the casing and which has a surface facing inwardly of the tubular casing, and wherein the removable end member is a rigid plate which seals against the inwardly-facing surface of the internal frame under the force of internal pressure within the chamber when the chamber is inflated.

4. An inflatable decompression chamber as claimed in claim 1 wherein the reinforcing filaments or yarns comprise 50 to 60 per cent by volume of the tubular wall of the casing.

5. An inflatable decompression chamber as claimed in claim 1 wherein the reinforcing filaments or yarns comprise polyaramid filaments or yarns.

6. A decompression chamber system comprising an inflatable decompression chamber of a size when inflated to accommodate a recumbent person; said chamber comprising an elongate tubular casing having end members for closing the casing to form the chamber, an entry port to the interior of the chamber, one of said end members being removable from a position in which the end member closes the entry port so as to provide access therethrough into the chamber, the casing comprising a flexible tubular wall of a silicone elastomer material incorporating circumferential windings of filaments of yarns within the wall, a second decompression chamber also having an entry port, and a linking element for linking the respective entry ports of the decompression chambers in fluid tight relation, wherein the linking element comprises a tubular male part and a tubular female part which are respectively sealingly connected or connectable to the respective entry ports of the decompression chambers, the male and female parts of the linking element having respective external and internal surfaces which are shaped at least in part to correspond and to seal together when the decompression chambers are linked by the linking element and are internally pressurized, the respective external and internal surfaces of the male and female parts of the linking element each having projections and depressions which engage and hold the surfaces against sliding axially apart under internal chamber pressure.

7. The decompression chamber system claimed in claim 6, wherein the tubular male part of the linking element has a wall which is flexible to facilitate insertion of the male part into the female part, the projections and depressions on each of the corresponding surfaces of the male and female parts being a succession of circumferential beads and grooves of which the beads of one part engage in the grooves of the other part.

8. The decompression chamber system claimed in claim 7, wherein, in axial cross-section, the beads on the female part of the linking element have sides with different angles of slope in relation to the longitudinal axis of the female part, with those sides of the beads which face towards the entrance to the female part being steeper in slope than opposite sides of the beads, and the beads on the male part of the linking element having sides with different angles of slope in relation to the longitudinal axis of the male part, with the respective sides of the beads of the male and female parts which engage on linking of the parts having corresponding angles of slope.

* * * * *

UNITED STATES PATENT AND TRADEMARK OFFICE

CERTIFICATE OF CORRECTION

PATENT NO. : 5,255,673

DATED : October 26, 1993

INVENTOR(S) : Cardwell et al.

It is certified that error appears in the above-identified patent and that said Letters Patent is hereby corrected as shown below:

| | | |
|---|---|---|
| Col. 2 | line 38 | after "shore", insert --A--. |
| Col. 3 | line 42 | change "of" to --on--. |
| Col. 5 | line 60 | change "nad" to --and--. |
| Col. 6 | line 39 | change "of" to --or--. |

Signed and Sealed this

Seventh Day of June, 1994

Bruce Lehman

BRUCE LEHMAN

*Commissioner of Patents and Trademarks*

*Attest:*

*Attesting Officer*